US007160596B2

(12) United States Patent
Nien

(10) Patent No.: US 7,160,596 B2
(45) **Date of Patent: *Jan. 9, 2007**

(54) SLAT ASSEMBLY FOR BLIND

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 228 days.

This patent is subject to a terminal disclaimer.

(21) Appl. No.: 10/825,135

(22) Filed: Apr. 16, 2004

(65) Prior Publication Data

US 2005/0170130 A1 Aug. 4, 2005

(30) Foreign Application Priority Data

Jan. 30, 2004 (CN) ..... 093201376

(51) Int. Cl.
*E06B 9/00* (2006.01)

(52) U.S. Cl. ..... 428/56; 428/137; 160/236

(58) Field of Classification Search ..... 428/55, 428/56, 137; 160/236, 900
See application file for complete search history.

*Primary Examiner*—Alexander S. Thomas
(74) *Attorney, Agent, or Firm*—Troxell Law Office, PLLC

(57) ABSTRACT

A slat assembly for blind includes a plurality of column-like support rods and board-like support blocks each alternatively arranged in juxtaposition with others with an adhesive layer coated at the bottom surface for a woven fabric of various diagrams to be attached. The weaving spots of the woven fabric and the adjacent joints of the juxtaposed support rods and blocks thereof are securely bound together by the adhesive layer to form a rigid and straight piece of decoration article which is further cut in equal space into a plurality of slat pieces each having a cord passage hole disposed at both lateral sides thereon respectively to form a horizontal-type slat piece, or a hook hole disposed at one lateral side thereon to provide a vertical-type slat piece thereof.

9 Claims, 6 Drawing Sheets

SLAT ASSEMBLY FOR BLIND

BACKGROUND OF THE INVENTION

The present invention is related to a slat assembly for blind, including a plurality of column-like support rods and board-like support blocks each alternatively arranged in juxtaposition with others with an adhesive layer coated at the bottom surface thereon for a woven fabric of various diagrams to be attached thereto. Via the adhesive layer thereof, the weaving spots of the woven fabric and the adjacent joints of the juxtaposed support rods and blocks thereof are securely bound together to form a rigid and straight piece of decoration article which is further cut in equal space into a plurality of horizontal-type or vertical-type slat pieces with weaving diagrams and rich colors displayed thereon; whereby, when the slat pieces are turned or rolled, the alternatively arranged support rods and blocks with the woven fabric thereof will verify the diagrams displayed thereon to achieve special visual effects of the slat assembly thereof.

A conventional slat assembly for blind is made up of horizontal-type or vertical-type slat pieces which are molded via plastics into elongated and slim solid color slat pieces of sufficient strength and hardness before diagrams are printed or hot-pressed onto the surfaces of the horizontal-type or vertical-type slat pieces respectively to increase the overall beauty of the blind assembly in display. Finally, cord passage holes are punched at the slat pieces thereon for retaining cords to be led there-through.

There are some drawbacks to such conventional slat assembly for blind. First, the horizontal-type or vertical-type slat pieces, made of plastics, must be individually formed via injection molding, which is complicated in the process and thus difficult to produce the slat pieces quickly on a massive scale. Besides, the slat pieces must be further processed via printing or hot-pressing to apply the diagrams onto the surfaces thereof, which may boost the cost of production and is rather uneconomical in efficiency. Second, after long time of repeated friction of the slat pieces in use, the diagrams printed thereon can easily come or wear off, which not only mars the overall beauty of the blind, but also reduces the using lifespan of the slat pieces thereof. Third, the horizontal-type or vertical type slat pieces, made of plastics, can increase the burden of the environment in recycle. When burned off in disposal, the slat pieces thereof can also cause air pollution and harm the environment.

SUMMARY OF THE PRESENT INVENTION

It is, therefore, the primary purpose of the present invention to provide a slat assembly for blind, including a plurality of column-like support rods and board-like support blocks each alternatively arranged in juxtaposition with others with an adhesive layer coated at the bottom surface thereon for a woven fabric to be securely attached thereto; whereby, via the adhesive layer, the weaving spots of the woven fabric and the adjacent joints of the juxtaposed support rods and blocks thereof are securely bound together to form a rigid and straight piece of decoration article which is further cut in equal space to provide a plurality of horizontal-type or vertical-type slat pieces with weaving diagrams and rich colors displayed thereon, facilitating a fast and easy processing thereof so as to reduce the cost of production and achieve economical efficiency thereof.

It is, therefore, the secondary purpose of the present invention to provide a slat assembly for blind wherein, when the slat pieces thereof are turned or rolled, the alternatively arranged support rods and blocks with the woven fabric thereof will verify the diagrams displayed thereon to achieve special visual effects of the slat assembly thereof. Besides, via the weaving texture of the woven fabric, the slat pieces thereof are equipped with rich colors and three-dimensional diagrams, and, via the adhesive layer thereof, the woven fabric is securely bound with the support rods and blocks thereof, efficiently avoiding the loose yarns in the cutting operation thereof.

It is, therefore, the third purpose of the present invention to provide a slat assembly for blind wherein the slat pieces, made up of the support rods and blocks of bamboo materials, the woven fabric, and the adhesive layer, are easily disposed of in recycle or burning off without causing any burden or air pollution to the environment to provide an eco-friendly slat pieces thereof.

DETAILED DESCRIPTION OF THE PREFERRED EMBODIMENTS

Figure 3:
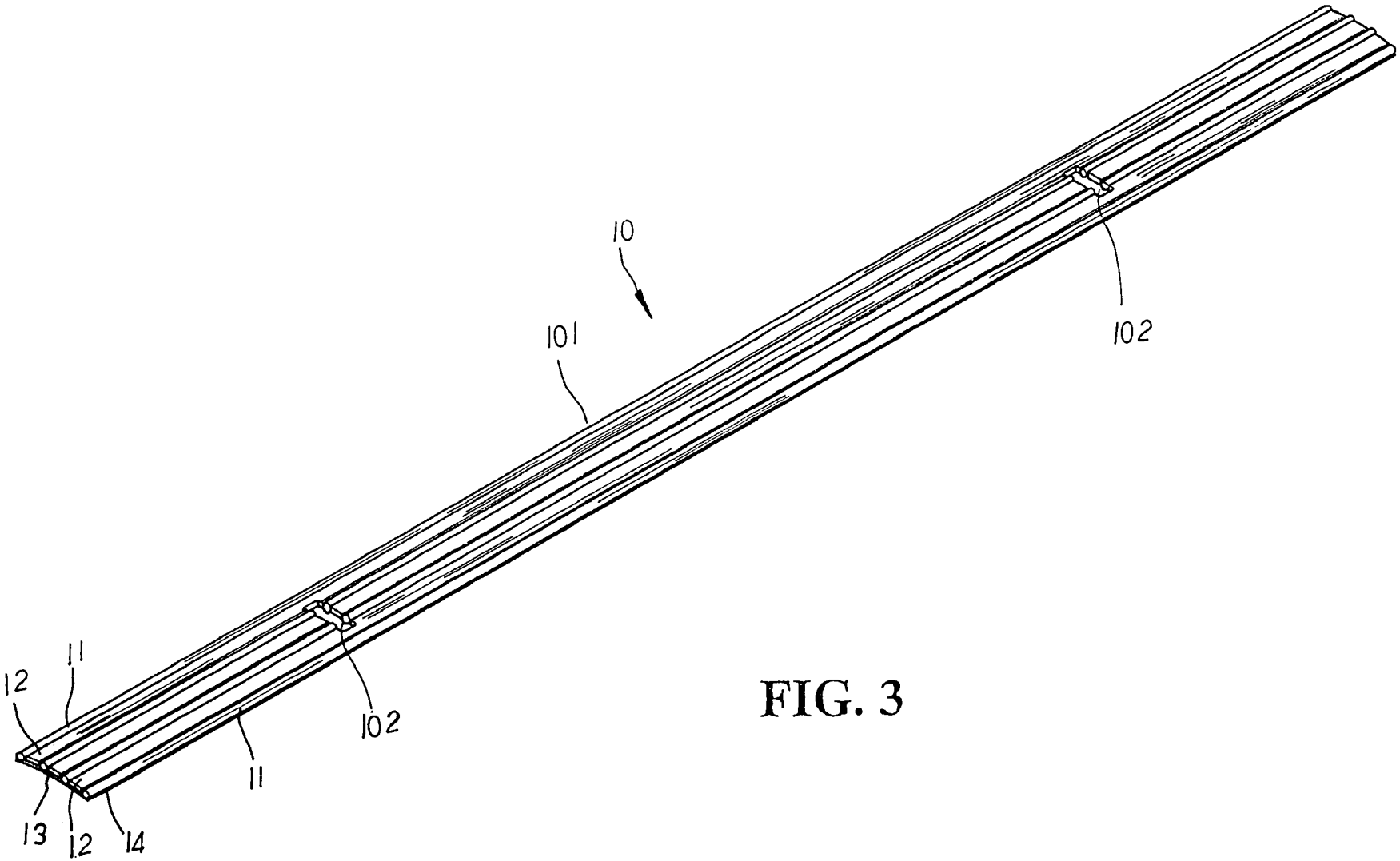
FIG. 3 is a perspective view of a horizontal-type slat piece of the present invention.
Figure 4:
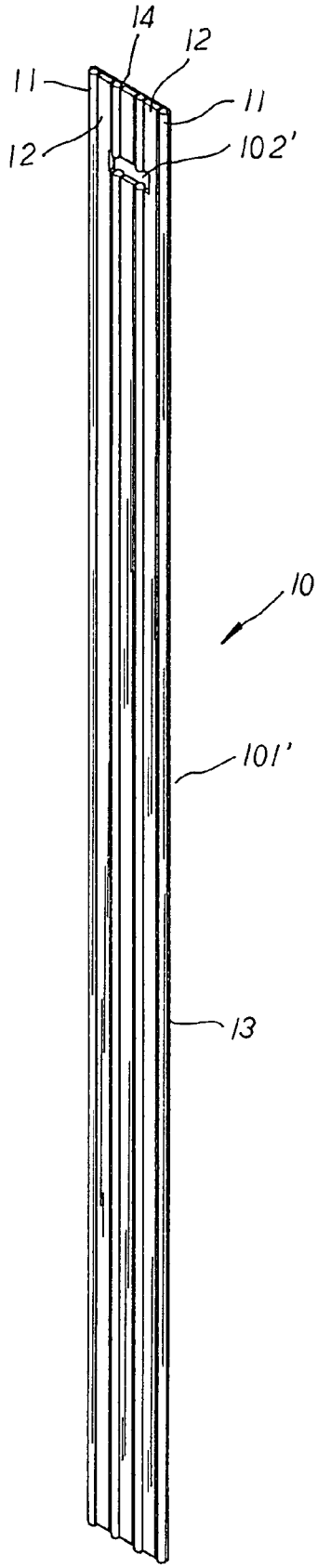
FIG. 4 is a perspective view of a vertical-type slat piece of the present invention.

Please refer to FIGS. 1 to 4 inclusive. The present invention is related to a slat assembly for blind, comprising a plurality of column-like support rods 11 and board-like support blocks 12 which, made of bamboo materials, are alternatively arranged in juxtaposition. A transparent adhesive layer 13 is coated at the bottom surface of the juxtaposed support rods 11 and support blocks 12 thereon for a woven fabric 14 of various diagrams and designs to be attached thereto. Via the adhesive layer 13 thereof, the weaving spots of the woven fabric 14 and the adjacent joints of the alternatively arranged support rods and blocks 11, 12 thereof are securely bound together to form a rigid and straight piece of decoration article 10 which is further cut in equal space into a plurality of slat pieces 101 of a preset size. Both lateral sides of each slat piece 101 thereof can be disposed with a cord passage hole 102 respectively for a retaining cord to be led there-through to provide a horizontal-type slat piece 101 as shown in FIG. 3. Otherwise, the decoration article 10 can also be equidistantly cut into a plurality of slat pieces 101 each having a hook hole 102 disposed at one lateral side thereon to form a vertical-type slat piece 101 as shown in FIG. 4. Thus, when the slat pieces 101, 101 thereof are turned or rolled, the alternatively arranged support rods and blocks 11, 12 with the woven fabric 14 thereof will verify the diagrams displayed thereon to achieve special visual effects of the slat assembly thereof. Besides, via the weaving texture of the woven fabric 14, the slat pieces 101, 101 thereof are equipped with rich colors and three-dimensional diagrams. And, via the adhesive layer 13 thereof, the woven fabric 14 is securely bound with the support rods and blocks 11, 12 thereof, efficiently avoiding the loose yarns in the cutting operation thereof.

Figure 1:
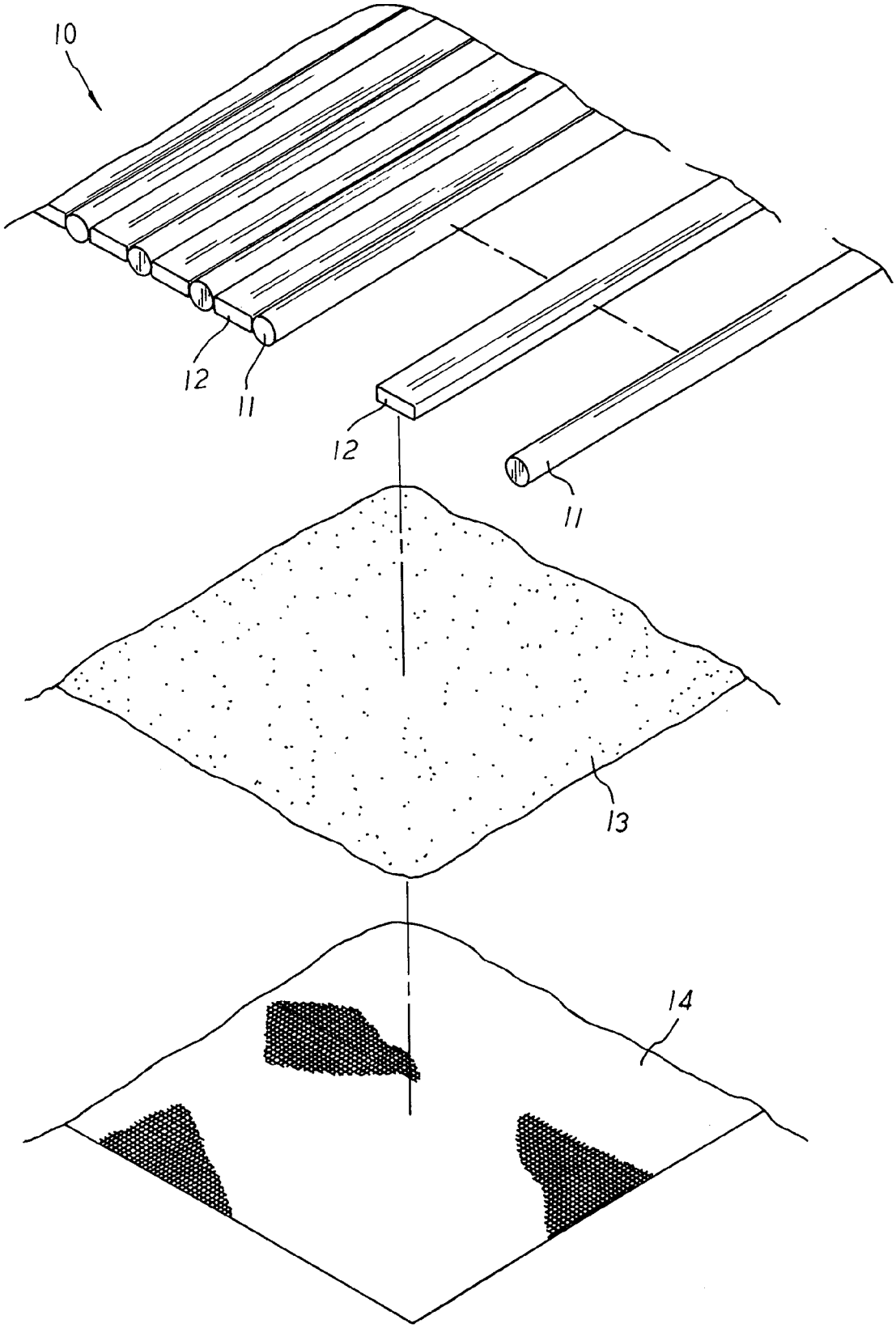
FIG. 1 is a perspective exploded view of the present invention.
Figure 2:
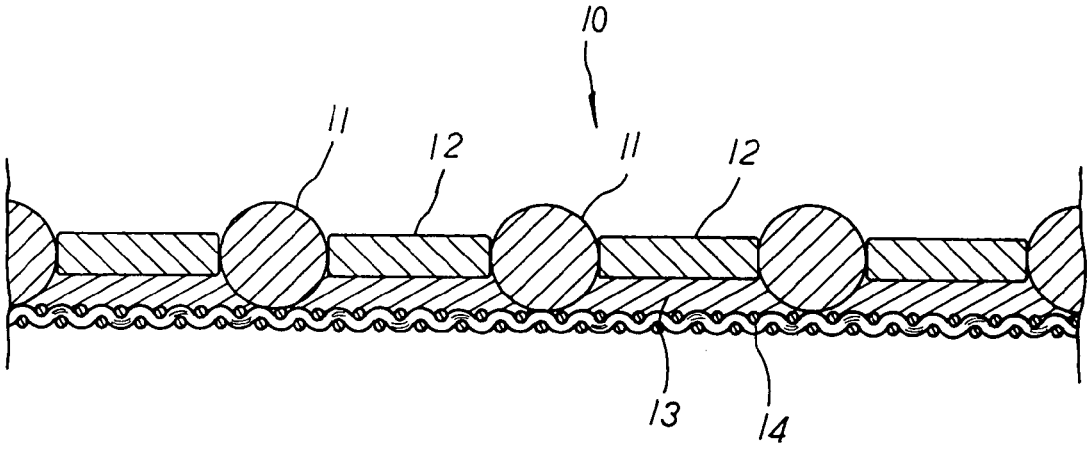
FIG. 2 is a cross sectional view of the present invention in assembly.
Figure 6:
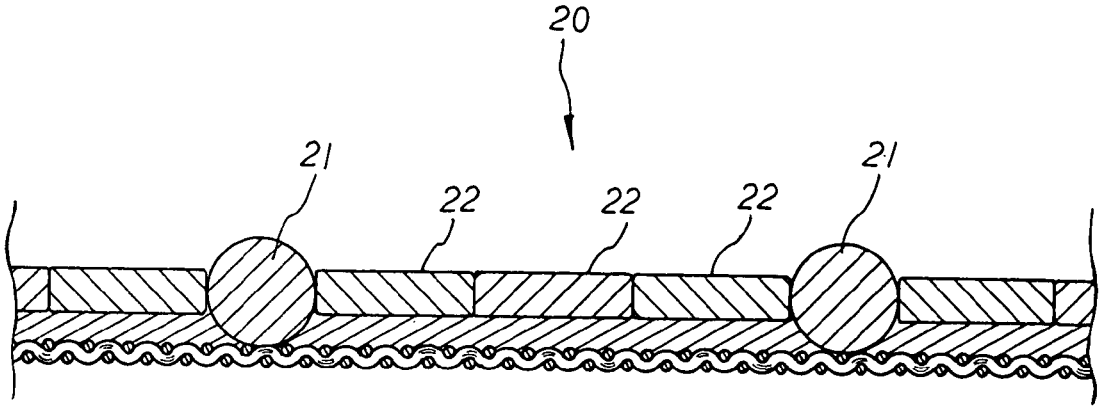
FIG. 6 is a cross sectional view of another embodiment of the present invention.
Figure 5:
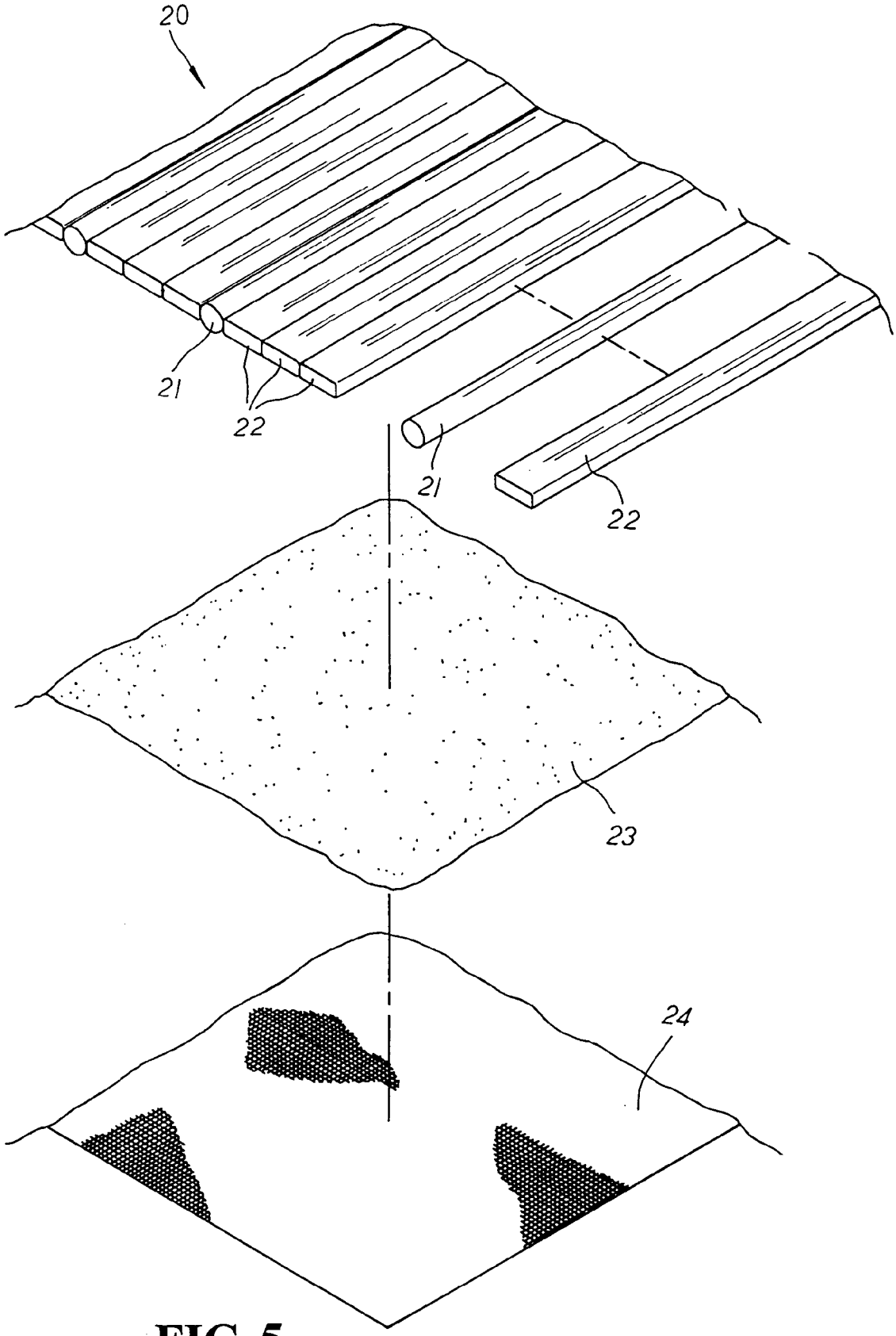
FIG. 5 is a perspective exploded view of another embodiment of the present invention.

Please refer to FIGS. 5 to 6 inclusive. The present invention can also have a plurality of column-like support rods 21 each alternatively juxtaposed with one or more than one board-like support blocks 22. At the bottom surface of the alternatively arranged support rods and blocks 21, 22 is coated an adhesive layer 23 to which a woven fabric 24 of various diagrams is applied and attached thereon. Thus, the weaving spots of the woven fabric 24 and the adjacent joints of the support rods and blocks 21, 22 thereof are securely bound together by the adhesive layer 23 to form a rigid and straight piece of decoration article 20.

Figure 7:
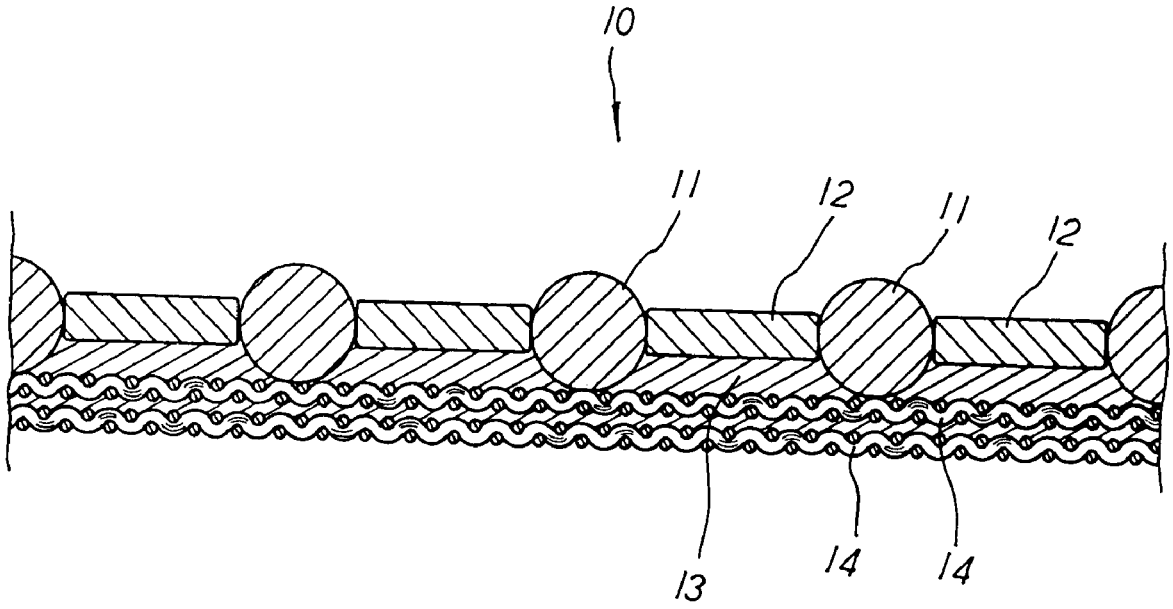
FIG. 7 is a cross sectional view of a third embodiment of the present invention.

Please refer to FIG. 7. The woven fabric 14, 24 of the decoration articles 10, 20 thereof can also be made up of one or more than one layers which are mutually fastened via the adhesive layer 13, 23 coated there-between.

What is claimed is:

1. A slat assembly comprising: a plurality of support rods and support blocks each alternatively arranged in juxtaposition with others with an adhesive layer coated at the bottom surface thereon for a woven fabric of various diagrams to be attached thereto; via the adhesive layer thereof, weaving spots of the woven fabric and the adjacent joints of the juxtaposed support rods and blocks are securely bound together by the adhesive layer to form a rigid and straight piece of decoration article which is further cut in equal space into a plurality of slat pieces of a preset size; thus, when the slat pieces are turned or rolled, the alternatively arranged support rods and blocks with the woven fabric thereof will verify the diagrams displayed thereon to achieve special visual effects of the blind assembly thereof; slat pieces thereof are equipped with rich colors and three-dimensional diagrams.

2. The slat assembly for blind as claimed in claim 1 wherein the support rods and support blocks are made of bamboo materials.

3. The slat assembly for blind as claimed in claim 1 wherein the support rods are column-like in shape.

4. The slat assembly for blind as claimed in claim 1 wherein the support blocks are board-like in shape.

5. The slat assembly for blind as claimed in claim 1 wherein the adhesive layer includes a transparent fastening agent.

6. The slat assembly for blind as claimed in claim 1 wherein each of the support rods is alternatively arranged in juxtaposition with one or more than one support blocks.

7. The slat assembly for blind as claimed in claim 1 wherein the woven fabric is made up of one or more than one layers which are mutually fastened via the adhesive layer coated there-between.

8. The slat assembly for blind as claimed in claim 1 wherein a cord passage hole is disposed at both lateral sides of each slat piece thereon respectively for a retaining cord to be led there-through to form a horizontal-type slat piece.

9. The slat assembly for blind as claimed in claim 1 wherein a hook hole is disposed at one lateral side of the slat piece thereon to form a vertical-type slat piece.

* * * * *